United States Patent [19]

Kobayashi et al.

[11] Patent Number: 4,979,997

[45] Date of Patent: Dec. 25, 1990

[54] PROCESS FOR PRODUCING GRAIN-ORIENTED ELECTRICAL STEEL SHEET HAVING SUPERIOR MAGNETIC AND SURFACE FILM CHARACTERISTICS

[75] Inventors: Hisashi Kobayashi; Katsuro Kuroki; Osamu Tanaka, all of Kitakyushu, Japan

[73] Assignee: Nippon Steel Corporation, Tokyo, Japan

[21] Appl. No.: 526,517

[22] Filed: May 21, 1990

[30] Foreign Application Priority Data

May 29, 1989 [JP] Japan ..... 1-135371

[51] Int. Cl.[5] ..... H01F 1/04

[52] U.S. Cl. ..... 148/111; 148/113; 148/16.6

[58] Field of Search ..... 148/111, 113, 16.6

[56] References Cited

U.S. PATENT DOCUMENTS

| | | | |
|---|---|---|---|
| 4,200,477 | 4/1980 | Datta et al. | 148/113 |
| 4,268,326 | 5/1981 | Iwayama et al. | 148/113 |
| 4,576,658 | 3/1986 | Inokut et al. | 148/111 |
| 4,632,708 | 12/1986 | Konno et al. | 148/113 |
| 4,875,947 | 10/1989 | Nakayama et al. | 148/113 |
| 4,929,286 | 5/1990 | Komatsu et al. | 148/111 |

FOREIGN PATENT DOCUMENTS

| | | | |
|---|---|---|---|
| 0318051 | 5/1989 | European Pat. Off. | 148/111 |
| 47-25250 | 7/1972 | Japan . | |
| 49-6455 | 3/1974 | Japan . | |
| 52-24116 | 2/1977 | Japan . | |
| 59-190324 | 10/1984 | Japan . | |
| 61-60896 | 12/1986 | Japan . | |
| 62-40315 | 2/1987 | Japan . | |

*Primary Examiner*—John P. Sheehan

*Attorney, Agent, or Firm*—Kenyon & Kenyon

[57] ABSTRACT

A process for producing a grain-oriented steel sheet having superior magnetic and surface film characteristics, which comprises the steps of: heating to a temperature of 1200° C. or lower an electrical steel slab comprising 0.025 to 0.075 wt % C, 2.5 to 4.5 wt % Si, 0.012 wt % or less S, 0.010 to 0.060 wt % acid-soluble Al, 0.010 wt % or less N, 0.080 to 0.045 wt % Mn, and the balance consisting of Fe and unavoidable impurities; hot-rolling the heated slab to form a hot-rolled steel sheet; cold-rolling the hot-rolled sheet to a final product sheet thickness by single cold rolling step or by two or more steps of cold rolling with an intermediate annealing therebetween; decarburization-annealing the cold-rolled sheet under a condition such that decarburization alone is effected until primary-recrystallized grains grow to an average grain size of at least 15 μm, and thereafter, concurrently effecting a decarburization and nitriding; applying an annealing separator to the decarburization-annealed sheet; and final-annealing the annealing separator-applied sheet.

5 Claims, 2 Drawing Sheets

PROCESS FOR PRODUCING GRAIN-ORIENTED ELECTRICAL STEEL SHEET HAVING SUPERIOR MAGNETIC AND SURFACE FILM CHARACTERISTICS

BACKGROUND OF THE INVENTION

1. Field of the Invention

The present invention relates to a process for producing a grain-oriented electrical steel sheet having superior magnetic and surface film characteristics.

2. Description of the Related art

Grain-oriented electrical steel sheets are mainly used as an iron core for transformers, generators and other electrical equipment, and must have a good surface film as well as good magnetic characteristics including magnetic exciting and watt-loss characteristics.

The magnetic characteristics of a grain-oriented electrical steel sheet are obtained through a Goss-orientation having a {110} plane parallel to the sheet surface and a <001> axis in the rolling direction, which is established by utilizing a secondary recrystallization occurring during a final annealing step.

To induce a secondary recrystallization to a substantially effective extent, fine precipitates of AlN, MnS, MnSe or the like, which act as an inhibitor for suppressing the growth of primary-recrystallized grains, must exist up to a temperature range in which a secondary recrystallization is effected during a final annealing. To this end, an electrical steel slab is heated to a high temperature of 1350° to 1400° C., to ensure a complete dissolution of inhibitor-forming elements such as Al, Mn, S, Se, and N. The inhibitor-forming elements completely dissolved in a steel slab are precipitated as fine precipitates such as AlN, MnS, and MnSe during the annealing of a hot-rolled sheet, or during an intermediate annealing carried out between cold rolling steps before a final cold rolling.

This process also has a problem in that a large amount of molten scale is formed during the heating of a slab at such a high temperature, and this makes frequent repairs to the heating furnace necessary, raises maintenance costs, causes a lowering of the facility operating rate, and leads to a higher consumption of energy.

To solve the above problem, research has been carried out into the development of a process for producing a grain-oriented steel sheet in which a lower slab heating temperature can be used.

For example, Japanese Unexamined Pat. Publication (Kokai) No. 52-24116 proposed a process in which a lower slab heating temperature of from 1100° to 1260° C. can be utilized by using an electrical steel slab containing Al and other nitride forming elements such as Zr, Ti, B, Nb, Ta, V, Cr, and Mo.

Japanese Unexamined Pat. Publication (Kokai) No. 59-190324 also proposed a process in which a slab heating temperature not exceeding 1300° C. can be utilized by using an electrical steel slab having a reduced carbon content of 0.01% or less and selectivity containing S, Se, Al, and B, and by a pulse annealing in which, during the primary recrystallization annealing after cold rolling, the steel sheet surface is repeatedly heated to a high temperature at short intervals.

Japanese Examined Pat. Publication (Kokoku) No. 61-60896 proposed another process in which a slab heating temperature lower than 1280° C. can be utilized by using an electrical steel slab having a Mn content of from 0.08 to 0.45% and a S content of 0.007% or less, to produce a reduced value of the [Mn] [S] product, and containing Al, P, and N.

Nevertheless, in these conventional processes, when used for producing a grain-oriented electrical steel sheet, a problem arises in that the surface glass film of a final product sheet occasionally is marred by a defect known as "frost-spotted pattern or "bare spots".

SUMMARY OF THE INVENTION

The object of the present invention is to provide a process for producing a grain-oriented electrical steel sheet having superior magnetic and surface film characteristics, by which a high productivity is ensured by using a slab heating temperature of 1200° C. or lower to reduce the energy needed for heating a slab, and thus the higher maintenance costs due to a high temperature slab heating, the lowering of the facility operation rate, and the lowering of productivity are avoided.

To achieve the object according to the present invention, there is provided a process for producing a grain-oriented steel sheet having superior magnetic and surface film characteristics which comprises the steps of:

heating an electrical steel slab comprising 0.025 to 0.075 wt % C, 2.5 to 4.5 wt % Si, 0.012 wt % or less S, 0.010 to 0.060 wt % acid-soluble Al, 0.010 wt % or less N, 0.080 to 0.45 wt % Mn and the balance consisting of Fe and unavoidable impurities to a temperature of 1200° C. or lower;

hot-rolling the heated slab to form a hot-rolled steel sheet;

cold-rolling the hot-rolled sheet to a final product sheet thickness by single cold rolling step or by two or more steps of cold rolling with an intermediate annealing therebetween;

decarburization-annealing the cold-rolled sheet under a condition such that a decarburization alone is effected until primary-recrystallized grains grow to an average grain size of at least 15 μm, and thereafter, decarburization and nitriding are concurrently effected;

applying an annealing separator to the decarburization-annealed sheet; and final-annealing the annealing separator-applied sheet.

The present inventive process enables the production of a grain-oriented electrical steel sheet having superior magnetic and surface film characteristics, by using a lower slab heating temperature not exceeding 1200° C.

The present invention is based on the novel finding that a surface glass film free from a "frost-spotted pattern" and having a good adhesion and appearance is formed even if the dewpoint of atmosphere is not specifically limited in the final annealing step, when the inhibitor-forming elements such as Al, N, Mn, S are not completely dissolved during the heating of a slab and a decarburization annealing is carried out in a manner such that a decarburization reaction alone is effected until primary-recrystallized grains grow to an average grain size of at least 15 μm, and thereafter, decarburization and nitriding reactions are concurrently effected to form an inhibitor mainly composed of (Al, Si)N.

DESCRIPTION OF THE PREFERRED EMBODIMENT

Figure 1:
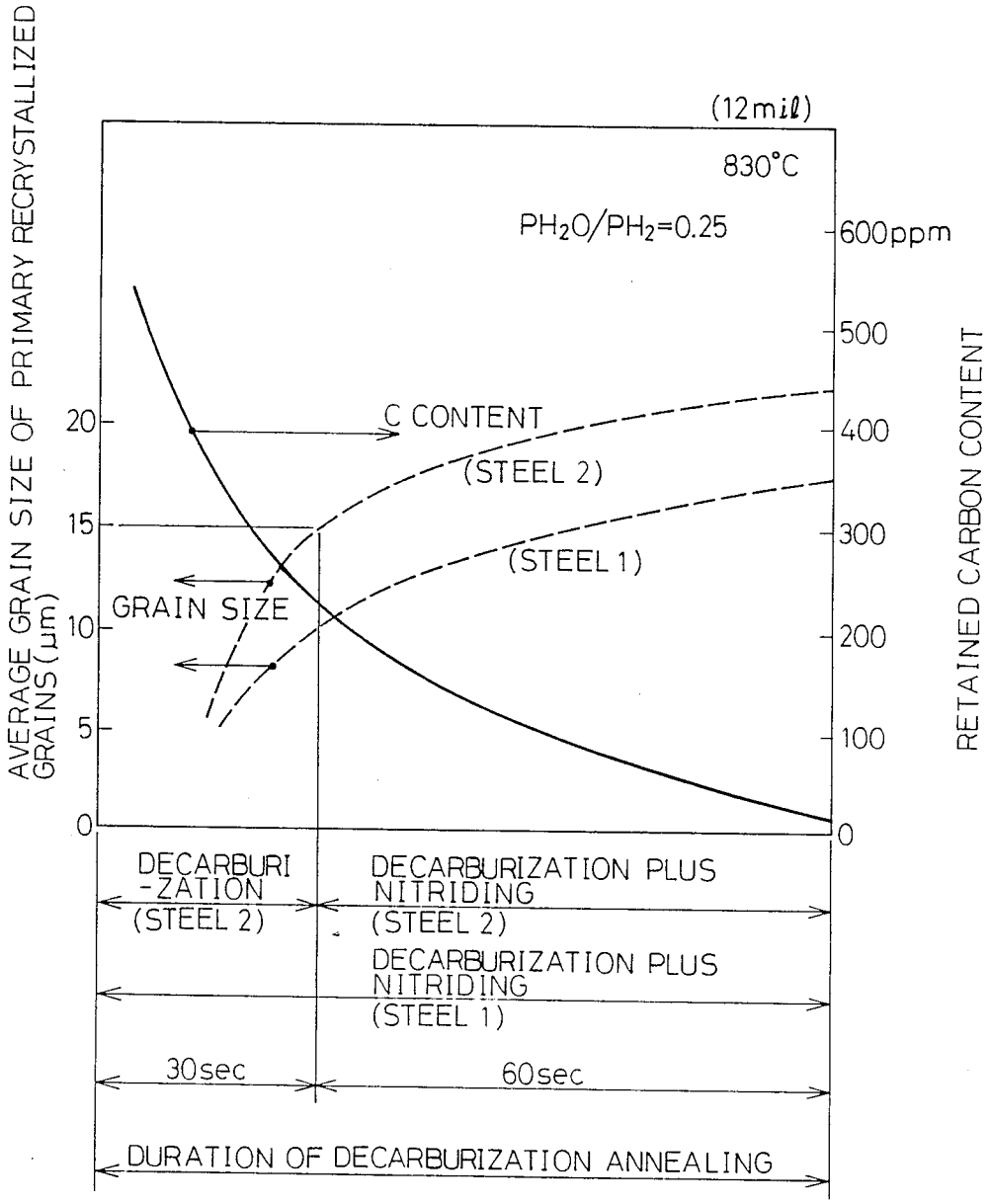
FIG. 1 shows variations of the grain size of primary-recrystallized grains and the content of carbon retained in steel as functions of the time lapsed during decarburization annealing.

An electrical steel slab to be used as the starting material in the present invention must have the specified composition, for the following reasons.

The C content must be 0.025 wt % or more because a C content of less than this lower limit causes an unstable secondary recrystallization, and even when the secondary recrystallization occurs, a resultant product sheet has a magnetic flux density as low as 1.80 Tesla in terms of the $B_{10}$ value. On the other hand, the C content must be 0.075 wt % or less because a C content of more than this upper limit requires a prolonging of the time needed for effecting decarburization annealing, and therefore, impairs productivity.

The Si content must be 2.5 wt % or more because a Si content of less than this lower limit fails to provide a product sheet having a Watt-loss value meeting a highest specified grade, i.e., a $W_{17/50}$ value of 1.05 W/kg or less for 0.30 mm thick product sheets. From this point of view, the Si is preferably present in an amount of not less than 3.2 wt %. An excessive amount of Si, however, frequently causes a cracking and rupture of a sheet during cold rolling and makes it impossible to stably carry out the cold rolling, and therefore, the Si content must be limited to not more than 4.5 wt %.

The limitation of the S content to 0.012 wt % or less is an important feature of the slab composition according to the present invention. Preferably, the S content is 0.0070 wt % or less.

In conventional processes such as disclosed by Japanese Examined Pat. Publication (Kokoku) Nos. 40-15644 and 47-25250, S is an indispensable component for forming MnS, which is one of the precipitates necessary to induce a secondary recrystallization. These conventional processes use a most effective S content range defined as an amount which can be dissolved in steel during a heating of a slab prior to hot rolling.

The present inventors, however, found that the presence of S adversely affects the secondary recrystallization. Namely, in the production of a grain-oriented electrical steel sheet by using (Al, Si)N as a precipitate necessary to induce the secondary recrystallization, S causes an incomplete secondary recrystallization when a steel slab containing a large amount of S is heated at a lower temperature and hot-rolled.

A complete secondary recrystallization is ensured for a steel slab containing 4.5 wt % or less Si when the S content of the slab is not more than 0.012 wt %, preferably 0.0070 wt % or less.

The present invention uses (Al, Si)N as a precipitate necessary to induce secondary recrystallization. This requires 0.010 wt % or more acid-soluble Al and 0.0030 wt % or more N, to ensure a necessary minimum amount of AlN. An Al content of more than 0.060 wt %, however, causes a formation of an inappropriate AlN and the secondary recrystallization becomes unstable. An N content of more than 0.010 wt % causes a swelling or "blister" on the steel sheet surface, and further, makes it impossible to adjust the grain size of primary-recrystallized grains.

The limitation of the Mn content is another important feature of a slab composition according to the present invention.

The present invention uses an electrical steel slab containing a Si content of 2.5 wt % or more to obtain a product sheet having a Watt-loss characteristic meeting a highest specified grade. To solve the problem of an incomplete secondary recrystallization occurring when such a high-Si slab is heated at a low temperature and hot-rolled, the present invention uses an extremely low S content. This means that, in the present invention, MnS can no longer be utilized as a precipitate to induce the secondary recrystallization, and therefore, the product sheets have a relatively low magnetic density.

The lower the Mn content, the more unstable the recrystallization, and the higher the Mn content the higher the obtaine $B_{10}$ value. Nevertheless, an excessive Mn addition, to an amount exceeding a certain level, brings no further improvement but leads only to a raising of production cost. The Mn content is therefore limited within the range of from 0.08 to 0.45 wt %, to ensure a good magnetic flux density of 1.89 Tesla or higher in terms of the $B_{10}$ value, a stable secondary recrystallization, and less cracking during rolling.

The present invention does not exclude the addition of minute amounts of Cu, Cr, P, Ti, B, Sn, and/or Ni.

A process according to the present invention is carried out in the following sequence.

A molten steel is prepared in a converter, an electric furnace or any other type of melting furnace, subjected to a vacuum degassing treatment in accordance with need, and continuous-cast to directly form a slab or cast to an ingot which is then blooming- or slabbing-rolled to form a slab.

The thus-formed slab is heated for hot rolling. The slab heating temperature is 1200° C. or lower, to ensure an incomplete dissolution of AlN in steel as well as a reduced consumption of energy for the slab heating. MnS has a high dissolution temperature and is naturally in the state of incomplete dissolution at such a low heating temperature.

The heated slab is hot-rolled, annealed in accordance with need, and then cold-rolled to a final product sheet thickness by a single cold rolling step or by two or more steps of cold rolling with an intermediate annealing therebetween.

The slab heating temperature as low as 1200° C. or lower according to the present invention incompletely dissolves Al, Mn, S, etc., in steel, and under that condition, inhibitors such as (Al, Si)N and MnS for inducing a secondary recrystallization are not present in a steel sheet. Therefore, N must introduced into the steel to form (Al, Si)N as an inhibitor, before the secondary recrystallization begins.

Conventional nitriding of steel sheets has been performed for a strip coil tightly wound in such a manner that it has a space factor of around 90%. Such a tight coil has a narrow space as small as 10 μm or less between steel sheets and the gas permeability through the coil is very low, and therefore, it takes a long time to substitute an atmosphere with a dry atmosphere, and to introduce and diffuse $N_2$ as a nitriding source between steel sheets. To mitigate these drawbacks, nitriding of a steel sheet in the form of a loose coil was attempted but was not satisfactory, because it does not eliminate the nonuniform nitriding due to a nonuniform temperature distribution in a coil, which is unavoidable when a steel sheet in the form of a strip coil is nitrided.

This problem also can be solved in the present inventive process if the nitriding of a steel sheet is effected when the not-coiled sheet is travelled through a $NH_3$ atmosphere in the latter stage of a decarburization annealing step according to the present invention, to form a fine (Al, Si)N as an inhibitor in the steel sheet.

In such an inline-nitriding of a steel sheet or strip, obviously the steel sheet must be nitrided within a short time, i.e., 30 sec to 1 min, for example.

A nitriding treatment prior to decarburization annealing can easily introduce nitrogen into steel but impedes the growth of primary-recrystallized grains during decarburization annealing and, in turn, the growth of secondary-recrystallized grains having a direct influence on the magnetic flux density of product sheets.

A nitriding treatment after decarburization annealing can effect nitriding without impeding the growth of primary-recrystallized grains but is industrially disadvantageous in that a special treatment becomes necessary to remove a barrier against nitriding formed on the steel sheet surface during decarburization annealing, and that a separate process step of nitriding is additionally required.

To solve these problems, the present inventors made various studies, and concluded that it is extremely industrially advantageous to perform a decarburization annealing step in a manner such that decarburization and nitriding are concurrently effected after primary-recrystallized grains grow to a certain grain size, because nitriding is easily effected and a separate process step of nitriding need not be added to the process step of decarburization annealing.

More specifically, a grain-oriented electrical steel sheet having superior magnetic and surface film characteristics is obtained without an additional process step of nitriding, by using a decarburization annealing in which the decarburization reaction alone proceeds until the primary-recrystallized grains grow to an average grain size of at least 15 μm, and thereafter, the decarburization and nitriding reaction are concurrently effected.

The present inventors found that, in the decarburization annealing step, the grain size of primary-recrystallized grains and the retained carbon content in steel vary with the decarburization time as shown in FIG. 1.

In FIG. 1, the solid curve shows the retained carbon content in an electrical steel and two broken curves show the grain size of primary-recrystallized grains of the same steel for two different sequences of decarburization annealing, i.e., a sequence in which nitriding was effected from the beginning of the decarburization annealing step (denoted as "Steel 1"), and a sequence in which nitriding was not initially effected but effected after the primary-recrystallized grains had grown to an average grain size of 15 μm (denoted as "Steel 2"). As the decarburization time lapsed, the content of carbon retained in steel is decreased while the primary-recrystallized grains grow. The magnetic characteristics of the final product sheets from Steels 1 and 2 are shown in Table 1.

TABLE 1

| | $B_{10}$ | $W_{17/50}$ |
|---|---|---|
| Steel 1 | 1.85 T | 1.3 W/kg |
| Steel 2 | 1.90 T | 1.02 W/kg |

It can be seen from the broken curve for Steel 1 that the growth of primary-recrystallized grains is impeded when nitriding is effected from the beginning of decarburization annealing, with the result that the grain size does not reach a value of 20 μm necessary to obtain a good magnetic flux density. Steel 1 has inferior magnetic characteristics as shown in Table 1. The nitrogen content of the steel was 180 ppm after the nitriding.

Vastly superior magnetic characteristics are obtained for the product sheet from Steel 2, as shown in Table 1, in which nitriding was effected after the average grain size had reached 15 μm when the retained carbon content was about 0.023 wt % (230 ppm).

The present invention specifies that nitriding must be effected after the primary-recrystallized grains have grown to an average grain size of at least 15 μm, because if the nitriding of a steel sheet is effected from the beginning of the decarburization annealing step, (Al, Si)N precipitates formed on the grain boundary of primary-recrystallized grains impede the growth of primary-recrystallized grains and, in turn, the growth of secondary-recrystallized grains during final annealing, with the result that the desired magnetic flux density (the $B_{10}$ value) and Watt-loss value of the final product sheet are not obtained.

According to the present invention, a concurrent decarburization and nitriding is effected after the primary-recrystallized grains have grown to an average grain size of at least 15 μm, to enable the production of a product sheet having a superior magnetic flux density (the $B_{10}$ value) and Watt-loss value such as exhibited by Steel 2 in Table 1.

The concurrent decarburization and nitriding effected in the latter stage of decarburization annealing step also has an industrial advantage in that the conventionally required separate step of nitriding may be omitted. Another advantage is that nitrogen is relatively easily introduced into the steel, because nitriding is effected before the growth of fayalite on the steel sheet surface.

Figure 2:
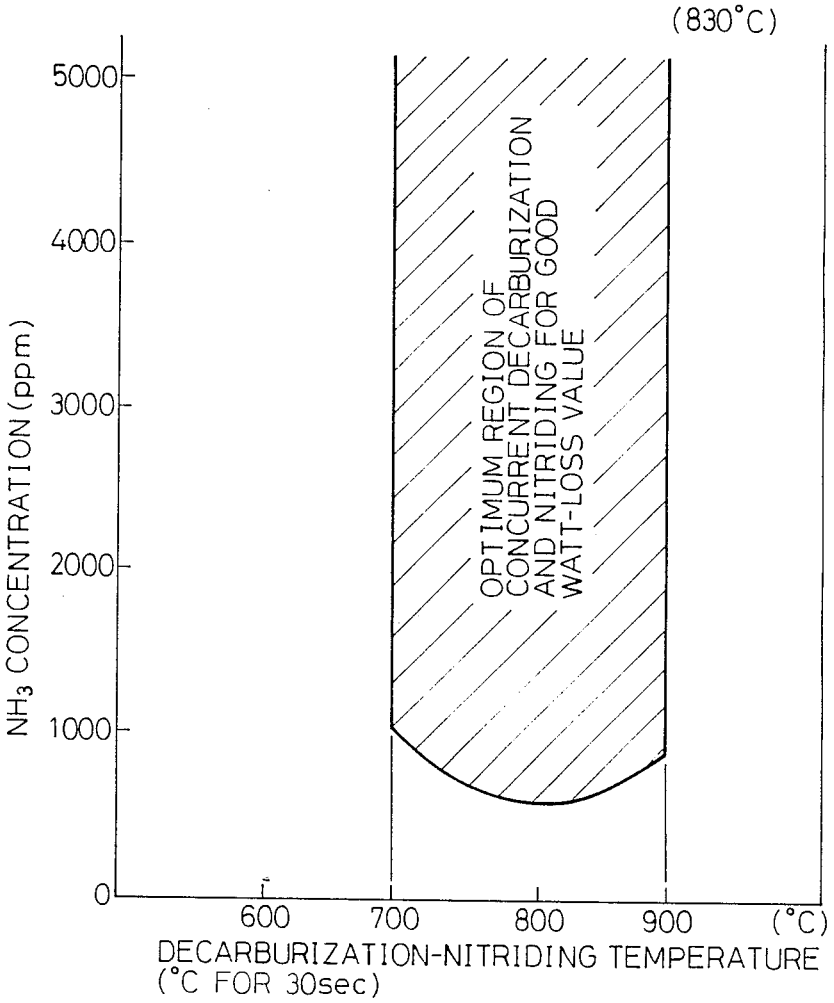
FIG. 2 shows an optimum region of concurrent decarburization and nitriding treatment in terms of the treatment temperature and the ammonia concentration of the treatment atmosphere.

FIG. 2 shows an optimum region of concurrent decarbulization and nitriding treatment to be effected in the latter stage of decarburization annealing step, in terms of the treatment temperature and the ammonia concentration added to an atmosphere of a mixed gas of nitrogen and hydrogen having a $P(H_2O)/P(H_2)$ ratio of 0.35.

According to the present invention, the concurrent decarburization and nitriding treatment in the latter stage of decarburization annealing step must be carried out in the temperature range of from 700° to 900° C., because the decarburization reaction is significantly suppressed at a treatment temperature lower than 700° C., whereas a treatment temperature higher than 900° C. causes an excessive coarsening of primary-recrystallized grains with a resulting incomplete secondary recrystallization. For example, a good secondary-recrystallized grain is obtained when a concurrent decarburization and nitriding is carried out at 800° C., and in an atmosphere having an ammonia concentration of 500 ppm or higher.

To practically carry out the present inventive process, the actual times of the sole decarburization and the concurrent decarburization and nitriding in the decarburization annealing step are preset or selected for specific cases, based on a pre-established relationship between the average grain size of the primary-recrystallized grains and the retained carbon content of the steel in terms of changes thereof with the passage of time, such as shown in FIG. 1, for various chemical compositions of steel sheets and for various levels of treatment temperatures.

The above-described nitriding procedure according to the present invention enables nitriding to be more stably and more uniformly effected than in a conventional nitriding procedure, in which a nitriding source is added to an annealing separator mainly composed of MgO.

Another advantage is provided when nitriding according to the present invention, in comparison with the conventional process. Conventionally, the composition, the dewpoint, the temperature, and other parameters of the gas atmosphere for the former stage of the final annealing step must be rigidly controlled for the nitriding of a steel sheet. In the present invention, however, these parameters may be controlled more freely or only for forming a good surface glass film having an excellent adhesion, because the nitriding of a steel sheet is completed before the final annealing.

The present invention, in which a not-coiled steel sheet can be nitrided while traveling, enables a production of a grain-oriented electrical steel sheet having a superior surface glass film and magnetic characteristics.

The present invention thus provides an extremely improved process for producing a grain-oriented electrical steel sheet having an excellent magnetic characteristic and a good surface glass film, by separately carrying out the nitriding of a steel sheet and the formation of a surface glass film, both of which were conventionally effected in a final annealing furnace.

EXAMPLES

Example 1

An electrical steel slab comprising 0.050 wt % C, 3.2 wt % Si, 0.07 wt % Mn, 0.025 wt % acid-soluble Al, 0.007 wt % S, and the balance Fe and unavoidable impurities was heated at 1200° C. and hot-rolled to form a 2.3 mm thick hot-rolled strip, which was then annealed at 1150° C. for 3 min and cold-rolled to a final product sheet thickness of 0.30 mm.

The cold-rolled strip was subjected to a decarburization annealing in which decarburization alone was effected at 850° C. for 70 sec in a mixed gas atmosphere of 75% $H_2$ plus 25% $N_2$ and having a dewpoint of 60° C., to cause an average grain size of 20 μm of the primary-recrystallized grains, and subsequently, a decarburization and nitriding were concurrently effected at 850° C. for 30 sec in an atmosphere of the same mixture as the above, plus ammonia gas introduced at a rate of 2000 ppm in terms of volume fraction. The nitrogen content of steel was 180 ppm after the nitriding.

After cooling, using a roll coater, the steel strip was applied with an annealing separator in the form of a water-suspended slurry, heated to 150° C. in a dryer furnace to remove water, and coiled to form a strip coil.

The strip coil was final-annealed in a final annealing furnace in a usual manner.

Table 2 shows the magnetic and the surface glass film characteristics of the thus-obtained product sheet. The comparative sheet product in Table 2 was obtained through a nitriding treatment in which nitrogen was fed from an atmosphere gas and from a nitrogen source added to an annealing separator.

TABLE 2

| | $B_{10}$ | $W_{17/50}$ | Defects(*) in Surface Glass Film |
|---|---|---|---|
| Comparative Sample | 1.90 T | 1.05 W/kg | Some |

TABLE 2-continued

| | $B_{10}$ | $W_{17/50}$ | Defects(*) in Surface Glass Film |
|---|---|---|---|
| Invention | 1.94 T | 0.97 W/kg | None |

(*)Spot-like defects at which a forsterite film is not present and having a metallic luster.

Example 2

An electrical steel slab comprising 0.06 wt % C, 3.2 wt % Si, 0.1 wt % Mn, 0.03 wt % acid-soluble Al, 0.008 wt % S, and the balance Fe and unavoidable impurities was heated at 1200° C. and hot-rolled to form a 2.3 mm thick hot-rolled strip, which was then annealed at 1150° C. for 3 min and cold-rolled to a final product sheet thickness of 0.23 mm.

The cold-rolled strip was subjected to a decarburization annealing in which the decarburization alone was effected at 830° C. for 70 sec in a mixed gas atmosphere of 75% $H_2$ plus 25% $N_2$ and having a dewpoint of 55° C. to cause an average grain size of 18 μm of the primary-recrystallized grains, and subsequently, a decarburization and nitriding were concurrently effected at 830° C. for 30 sec in an atmosphere of the same mixture as the above, plus ammonia gas introduced at a rate of 1000 ppm in terms of volume fraction. The nitrogen content of steel was 150 ppm after the nitriding.

After cooling, using a roll coater, the steel strip was applied with an annealing separator in the form of a water-suspended slurry, heated to 150° C. in a dryer furnace to remove water, and coiled to form a strip coil.

The strip coil was final-annealed in a final annealing furnace in a manner such that the atmosphere in the furnace had a dewpoint of 10° C. until the coil was heated to 850° C. and then a dry atmosphere was substituted therefor.

Table 3 shows the magnetic and the surface glass film characteristics of the thus-obtained product sheet. The comparative sheet product in Table 3 was obtained through a nitriding treatment in which nitrogen was fed from an atmosphere gas.

TABLE 3

| | $B_{10}$ | $W_{17/50}$ | Defects(*) in Surface Glass Film |
|---|---|---|---|
| Comparative Sample | 1.91 T | 0.93 W/kg | Some |
| Invention | 1.93 T | 0.85 W/kg | None |

(*)Spot-like defects at which a forsterite film is not present and having a metallic luster.

The present inventive process has a valuable effect and makes a great contribution to industry in that it simultaneously improves both the magnetic characteristic and the surface glass film characteristic, and that the nitriding of a steel sheet can be effected while it is travelling not in the form of a coil and before final annealing, whereas the nitriding has been conventionally effected in a final annealing furnace.

We claim:

1. A process for producing a grain-oriented steel sheet having superior magnetic and surface film characteristics, which comprises the steps of:

heating to a temperature of 1200° C. or lower an electrical steel slab comprising 0.025 to 0.075 wt % C, 2.5 to 4.5 wt % Si, 0.012 wt % or less S, 0.010 to 0.060 wt % acid-soluble Al, 0.010 wt % or less N, 0.080 to 0.45 wt % Mn, and the balance consisting of Fe and unavoidable impurities;

hot-rolling the heated slab to form a hot-rolled steel sheet;

cold-rolling the hot-rolled sheet to a final product sheet thickness by single cold rolling step or by two or more steps of cold rolling with an intermediate annealing therebetween;

decarburization-annealing the cold-rolled sheet under a condition such that decarburization alone is effected until primary-recrystallized grains grow to an average grain size of at least 15 μm, and thereafter, decarburization and nitriding are concurrently effected;

applying an annealing separator to the decarburization-annealed sheet; and final-annealing the annealing separator-applied sheet.

2. A process according to claim 1, wherein said concurrent decarburization and nitriding are effected in an atmosphere prepared by adding ammonia gas to a nitrogen and hydrogen mixture having a $P(H_2O)/P(H_2)$ ratio of 0.15 or higher and in a temperature range of from 700° to 900° C.

3. A process according to claim 1, wherein said slab contains 3.2 to 4.5 wt % Si.

4. A process according to claim 1, wherein said slab contains 0.0070 wt % or less S.

5. A process according to any one of claims 1 to 4, wherein the not-coiled cold-rolled sheet is decarburization-annealed while travelling.

* * * * *